US005737929A

United States Patent [19]

Siosteen et al.

[11] Patent Number: 5,737,929

[45] Date of Patent: Apr. 14, 1998

[54] METHOD AND MEANS FOR SEPARATING OIL AND IMPURITIES FROM A REFRIGERANT IN AN AIR CONDITIONING SYSTEM

[75] Inventors: Arvo Siosteen, Saro; Morgan Henriksson, Goteborg, both of Sweden

[73] Assignee: Cool Engineering, Hisingsbacka, Sweden

[21] Appl. No.: 668,714

[22] Filed: Jun. 24, 1996

Related U.S. Application Data

[63] Continuation of Ser. No. 410,286, Mar. 24, 1995, abandoned.

[30] Foreign Application Priority Data

Mar. 28, 1994 [SE] Sweden ..... 9401027

[51] Int. Cl.[6] ..... F25B 43/02

[52] U.S. Cl. ..... 62/84; 62/85; 62/303

[58] Field of Search ..... 62/77, 84, 85, 62/475, 470, 292, 303

[56] References Cited

U.S. PATENT DOCUMENTS

| | | | |
|---|---|---|---|
| 2,875,592 | 3/1959 | Olsen | 62/470 |
| 3,520,149 | 7/1970 | Uratani | 62/470 |
| 3,777,509 | 12/1973 | Muench | 62/84 |
| 4,506,523 | 3/1985 | DiCarlo et al. | 62/470 |
| 5,231,843 | 8/1993 | Keltner . | |
| 5,247,812 | 9/1993 | Keltner . | |

*Primary Examiner*—John M. Sollecito
*Attorney, Agent, or Firm*—Laurence R. Brown

[57] ABSTRACT

Method and apparatus are disclosed for separting a refrigerant from oil and/or impurities contained in components of a compressor cooling system. When retrofitting a compressor cooling system using a CFC refrigerant into use of a chloride HFC refrigerant, the mineral oil mixed into the CFC refrigerant has to be seperated. It is thereby a problem that the oil is spread in all the components of the system and that existing cleansing technique is not efficient, since it does not cleanse all the components as the technique used involves that some of the components are by-passed. According to the invention these problems are solved by temporarily connecting an oil removal device in series with the compressor cooling system without having to by-pass any components. The compressor cooling system is filled with refrigerant, e.g. R134*a*. When starting the system the oil and/or impurities are carried with the refrigerant, as during normal service, but is separated from the system when the refrigerant, oil and/or the impurities reach the separation tank (3) of the device. The oil and/or impurities are thereby accumulated in the oil tank (12) of the device. The oil tank (12) may be heated in order to ensure that the refrigerant will not condense and be collected in the oil tank (12). The oil removal device may be connected into several systems for cleaning cycles before removing accumulated oil from the oil separation device of this invention. Thus, an inspection glass 10 permits visual checking of the oil level.

7 Claims, 1 Drawing Sheet

METHOD AND MEANS FOR SEPARATING OIL AND IMPURITIES FROM A REFRIGERANT IN AN AIR CONDITIONING SYSTEM

This application is a continuation of application Ser. No. 08/410,286, filed Mar. 24, 1995, now abandoned.

BACKGROUND OF THE INVENTION

The present invention relates generally to a method for separating oil and/or impurities from components connected to a compressor cooling system. It also relates to simple but effective device used for carrying out separation and cleansing.

Most of present compressor cooling systems include a refrigerant of the CFC type (CFC=ChloroFluoroCarbon), which evidently contains chlorine and which in Europe will be forbidden from 1995 and on, since the CFC refrigerants have a detrimental effect on the protective shield of ozone that protects all life on earth from the very strong UV-radiation. Existing compressor cooling systems therefore have to be converted into systems using chlorine free refrigerant of the HFC type (HFC=HydroFluoroCarbons), for example R134*a* (TetraFluoroEthane). When making this conversion, the oil in the system, used for lubricating the compressor, must be changed from the earlier used mineral oil into PAG oil (PAG=PolyAlcyleneGlycol) or ester oil. If the oil is not changed, the service life of the compressor will be shortened, or alternatively if the system is filled up with new PAG or ester oil and with the remaining mineral oil still in the system, the capacity of the system will be adversely reduced.

The main problem when converting from the first mentioned refrigerant to the latter is to eliminate or remove as much as possible of the mineral oil which is distributed in all components in the compressor cooling system. A similar problem arises when cleansing a compressor cooling system from impurities. The most commonly used technique for emptying the compressor cooling system from oil and/or impurities is to cleanse the system with an external cleansing equipment. It is well known that this technique is inefficient and very time consuming. The compressor, which contains a major part of the compressor oil, is not emptied from oil when using an external cleansing equipment, since it is by-passed. If the system contains an accumulator this is also by-passed. If the expansion means is a capillary tube it is dismounted from the system or by-passed. If the expansion means is a valve it is by-passed or opened by external manipulation before cleansing the system. When using this technique a refrigerant of the CFC type is often used, and as stated above the CFC is environmentally detrimental and sale thereof will be more and more restricted in the future. Some external cleansing equipments use another substance than refrigerant for cleansing compressor cooling systems. In such case this substance in question has to be eliminated before the compressor cooling system is retrofitted with another refrigerant for normal service.

SUMMARY OF THE INVENTION

The object of the invention is to solve the above mentioned problems, i.e. to quickly and effectively eliminate mineral oil and/or impurities from all the components of a compressor cooling system, without having to by-pass any component and to cleanse the compressor cooling system using its own refrigerant, for example R134*a*.

The method and the means according to the invention constitute a solution to these problems. The method according to the invention is distinguished in:

that a device is connected temporarily in series with the compressor cooling system, preferably in the part of the system where the refrigerant is gaseous for removing oil during a separation/cleansing cycle of the compressor cooling system;

that the separation/cleansing is effected with the help of a refrigerant; and that the separation/cleansing is made during normal service when all the components in the compressor cooling system are connected.

The method results in that oil and/or impurities are separated from the refrigerant in an oil separation device comprising part of the invention.

The separation occurs in an upper part of a separation tank in a vessel, whereafter the refrigerant continues to circulate around the compressor cooling system through an outlet opening, whereby the oil and/or potential impurities are collected in the lower part of the vessel namely an oil tank.

BRIEF DESCRIPTION OF THE DRAWINGS

In the enclosed drawings a preferred embodiment of the means according to the invention is schematically shown, where.

DETAILED DESCRIPTION OF THE PREFERRED EMBODIMENT

Figure 1:
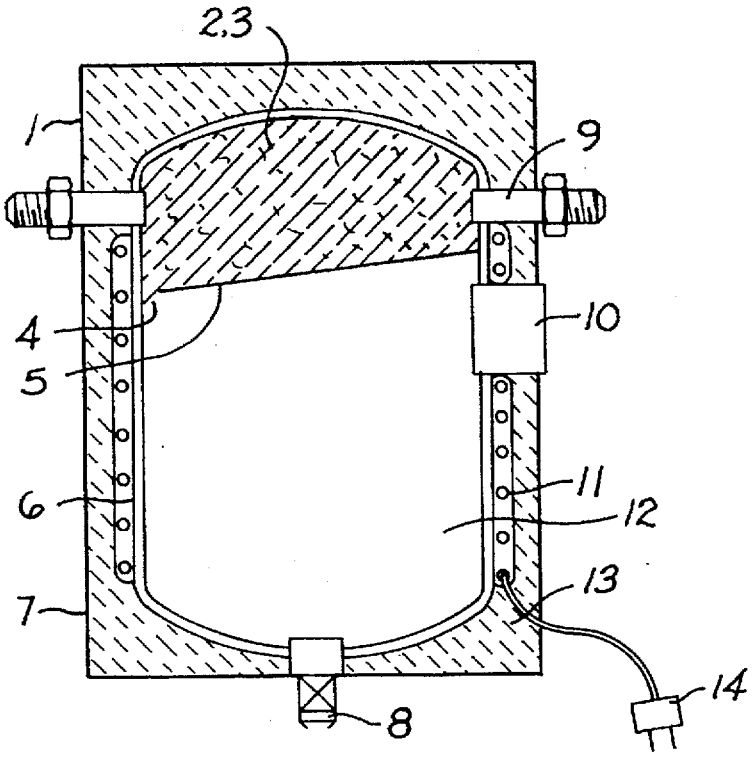
FIG. 1 shows a cross section through the means.
Figure 2:
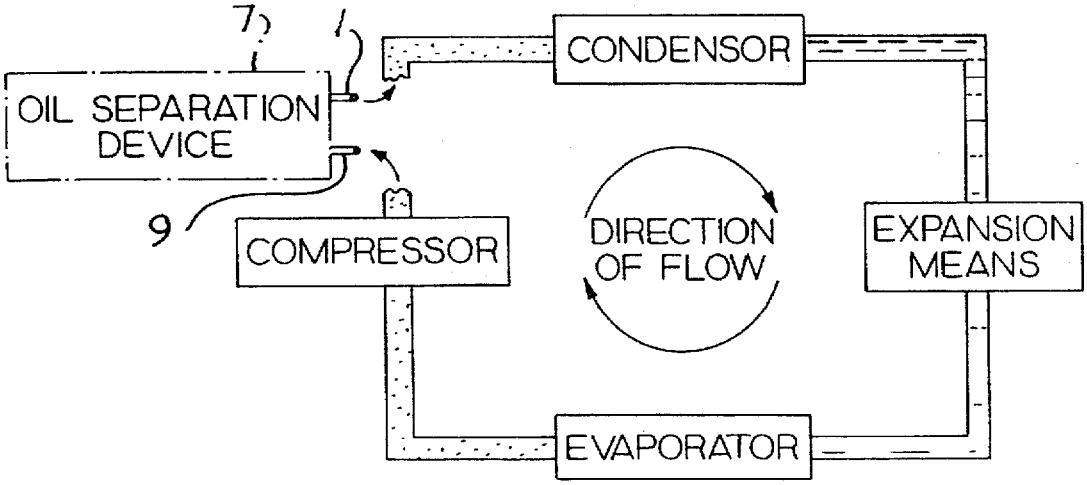
FIG. 2 shows a schematic view of a compressor cooling system.

The schematic view according to FIG. 2 shows in which parts of a compressor cooling system the refrigerant in service is in a gaseous condition. The device is preferably connected in series with the system as illustrated in phantom view where the refrigerant is in a gaseous condition.

The method according to the invention serves to cleanse a compressor cooling system from oil and/or impurities by connecting the oil separation device of the invention in series with the system, whereby oil and/or impurities in normal service are separated from the refrigerant. The oil separation device is preferably connected to the part of the system where the refrigerant during a cleansing operation cycle is gaseous. This promotes the separation between the refrigerant and the oil and/or impurities. During the cleansing operation cycle the refrigerant is in its gaseous condition between the evaporator and the condensor (FIG. 2). It is preferred to connect the device on the gaseous high pressure side, i.e. between the compressor and the condensor instead of in the gaseous low pressure side, i.e. between the evaporator and compressor. It is advantageous to connect the oil separation device on the high pressure side, since thereby the part of the oil that during the initial phase of the purifying process is contained in the compressor does not have to circulate in all of the components of the compressor cooling system before it reaches the oil separation device. Another advantage is that the compressor will have a larger oil volume for its lubrication during the cleansing process than if the device were to be connected upstream of the compressor, i.e. on the gaseous low pressure side.

According to the method the compressor cooling system is filled with refrigerant, e.g. R12, R22 or the chlorine free R134*a*, and the system is started. The refrigerant brings the oil and/or the impurities with it through the system. When the refrigerant, oil and/or impurities reach the vessel of the oil separation device, a major part of the oil and/or the impurities will be separated from the refrigerant. The refrigerant continues out in the system and carries with it more oil and/or impurities. The compressor cooling system is a completely closed system, which means that the refrigerant will circulate in the system, and when entering the oil separation device the oil and/or impurities that have been brought with it will be separated from the refrigerant.

Experiments

Reference is made below to seven experiments made with the compressor in a cycling condition, the results of which more evidently clearifies the method according to the invention. In a compressor cooling system where one or more of the components are designed so that the refrigerant has problems to bring with it oil and/or impurities, the necessary time for the purifying process will be longer if the same degree of purification is to be reached. The compressor will then work during a longer time, which may cause the temperature in the compressor to rise. The lubricating oil volume in the compressor is lower than at normal service, because the device accumulates the oil. These two factors result in that the risk for damaging the compressor becomes higher. Therefore the temperature rise should be limited.

1) Experiments have shown that an effective way to lower the compressor temperature is to make the compressor work cyclically, i.e. turning it on and off alternatingly.

2) Experiments with transparent components have shown that the flow of refrigerant starts with a jerk when the compressor is started. This jerk pulls with it parts of the oil and/or impurities that otherwise would not have carried along by the refrigerant flow.

3) Experiments have shown that at the start a part of the refrigerant will be in a liquid condition on the "gaseous side" of the compressor cooling system. Liquid is a better means to transport oil and impurities than gas.

The experiments in 2) and 3) above thus show that cycling of the compressor may diminish the time necessary for the cleansing process.

4) Experiments have shown that if a refrigerant is used that is not mixable with mineral oil, e.g. R134*a*, it may be more difficult to bring the oil with the refrigerant flow, whereby the necessary time for the cleansing process will be longer, if the same degree of cleansing is to be reached. Cycling of the compressor may shorten the time that has to be spent on the cleansing process according to the above mentioned experiments according to 2) and 3) and the compressor temperature may be diminished according to point 1).

5) Experiments have shown that the ability of the refrigerant flow to carry along oil may be increased if the compressor cooling system is overfilled with the refrigerant, i.e. a larger amount of refrigerant is used than the recommended amount for normal service. The result is that the time for the cleansing process can be reduced.

6) Experiments have shown that if the oil separation device is connected in series with the fluid side of the compressor cooling system, i.e. between the condensor and expansion means (see FIG. 2), instead of the recommended connection on the gaseous side, the invention will work, though only under certain circumstances.

When the device according to the invention is connected to the liquid side it is important, in order to get the device to work in a satisfactory manner, that the device is not filled with refrigerant in its liquid phase. In order to get the oil separation device to accumulate oil, the refrigerant liquid level may not reach the outlet 1. The refrigerant liquid level may be limited by keeping the temperature of the oil separation device at such a high level that an adequate amount of the refrigerant is evaporated and/or that the compressor alternatingly is turned on and off, so called cycling, and that the relation between the time in an on-condition and the time in an off-condition is kept such that an adequate amount of refrigerant is evaporated during the off period, so that the liquid level will not have time to reach the outlet 1 during the time when the compressor is turned on. However, the time when the compressor is turned on has been long enough for it to have time to transport oil and/or impurities.

7) Experiments have shown that if the device is connected in a reverse state, i.e. that the in-connection at the compressor cooling system is connected to the outlet and the out-connection of the compressor cooling system is connected to the inlet 9, the invention still works.

The compressor may be cycled, i.e. it is alternatingly switched on and off, according to the above mentioned experiment, with the aid of:

either the pressure switch or the temperature switch of the compressor cooling system or both:

or by manually switching on and off the compressor cooling system;

external regulation.

Degree of Purification

According to the invention the oil separation device cleanses all the components in a compressor cooling system from oil and/or possible impurities. Existing receptacles for drying agent in the compressor cooling system may be difficult to cleanse from oil. The receptacles contain old drying agent which is not adapted to the new refrigerant, e.g. R134*a*. This in combination with a content of oil therein, implies that the receptacles should be changed when making a retrofitting operation.

When a compressor cooling system is cleansed from oil with the oil separation device according to the invention, the amount of oil lubricating the compressor will continuously diminish. If the purification time is very long, the risk that the compressor is damaged therefore will increase. However, experiments have been performed wherein the compressor cooling system has been cleansed from approximately 95% of the oil during the first 10 minutes of the test whereafter the compressor cooling system has been operated for several hours without damaging the compressor. If a compressor cooling system contains one or more oil traps, it may take quite a while to cleanse such traps from oil; it should however be considered to lower the demand on degree of purification from oil and instead shorten the time for the cleansing process. This gives two advantages:

a shorter time for the conversion and retrofitting operation;

decreased risk for damages to the compressor.

Means According to the invention

The oil and/or impurities are separated from the refrigerant by allowing the refrigerant, the oil and/or the impurities to pass through an inlet 9 and an oil absorbing filter body 2 in a separation tank 3. The oil absorbing filter body 2 consists of steelwool, the density and flow area of which on one hand may not give such a great pressure drop that the refrigerant will condense, and on the other hand may not give such a great flow area that the flow speed gets too low, so that the separation is deteriorated. One kind of the filter material that may be used to satisfy these criteria is the material commonly used in filters for kitchen fans. The filter material contains an undulated steel wire net which is folded in several layers in order to reach a suitable density. The oil absorbing filter body 2 is manufactured in a larger dimension than the volume of the separation tank 3. This means that the oil absorbing filter body 2 is pressed against the inner surface of the separation tank 3 when mounted, which limits the risk that there will be a gap between the oil absorbing filter 2 and the inner surface of the separation tank 3. If there is a gap parts of the refrigerant flow and thereby oil and/or impurities would not pass the whole filter, which would deteriorate the separation. After the oil absorbing filter body 2, the refrigerant will flow out through the outlet 1 into the compressor cooling system.

The oil in the filter flows down on an inclined sheet metal piece 5 and therefrom through a gap 4. In the gap the oil flows down from the separation tank 3 to an oil tank 12.

If parts of the refrigerant are accumulated in the oil tank 12 the refrigerant flow in the compressor cooling system will decrease, which renders it more difficult for the remaining refrigerant in the system to carry along oil and/or impurities. In those parts of the compressor cooling system where oil and/or impurities are situated on the gaseous side of the refrigerant and/or where the oil and/or impurities are situated in so called oil traps, e.g. parts of the evaporator, the receptacle for drying agent, it is important to have a large flow of refrigerant in order to catch all of the oil and/or impurities. The whole vessel 6 therefore has to be warmer than the condensation temperature of the refrigerant, or else the refrigerant will condense and stay in the oil tank 12 instead of circulate in the system in order to catch the oil. The refrigerant thus circulates through the compressor cooling system, since it is a closed system (see FIG. 2). The heating of the vessel 6 is performed by a heating element 11 which preferably is arranged on the outer surface of the vessel 6. The heating element is energized by electricity from an electrical connection 14.

Since the oil separator is heated it is insulated with insulating material 13. This material is fixed between the vessel 6 and an outer casing 7.

The oil separation device is removed from the closed system after the cleansing cycle of compressor system operation and may be used for cleansing several compressor cooling systems without having to empty the tank 12 from oil between the operations. However, the oil level may not reach the gap 4 in the collector sheet metal piece 5. If so, there is a risk that separated oil will be carried along by the refrigerant through the outlet 1. In order to check whether the oil level is close to the collector sheet metal piece 5, there is an inspection glass 10 on the outer surface of the oil tank 12. The inspection glass 10 is preferably mounted as high as possible but not above the collector sheet metal piece 5. Thus, when the operator—by using the inspection glass 10—has visually checked that the oil tank 12 is full with oil, the oil tank 12 is emptied by using a drain valve 8 or the outlet 1. The outlet may be used for emptying if it is necessary to empty the tank quickly or it is desired to prevent that impurities block the drain valve 8.

We claim:

1. The method of removing residual oil from all operating components of a compressor cooling system in an oil separation cleansing cycle before charging with refrigerant for further cooling system operation, comprising in combination, the steps of:

temporarily connecting an oil separation device in series with a closed compressor cooling system for circulating refrigerant therethrough for removing residual oil in an oil cleansing cooling system cycle, separating oil from the circulating refrigerant into an oil separation tank carried by the oil separation device, and operating the compressor cooling system in the oil cleansing cycle with a refrigerant adapted to carry oil from all operating components of the closed compressor cooling system as the refrigerant circulates through the oil separation device during a compressor cooling cycle to thereby to separate oil and remove oil from said closed system into said separation tank before removing the oil separation device for use in cleansing cycles of other closed compressor cooling systems.

2. The method of claim 1 further comprising the step of intermittently operating the compressor cooling system on and off during said oil separation cleansing cycle.

3. The method of claim 1 wherein the closed compressor cooler system has a compressor connected between higher and lower pressure parts of the cooling system further comprising the step of connecting the oil separation device into the closed system on the high pressure side of the compressor.

4. The method of claim 3 wherein the closed cooler system comprises a compressor coupled to pass refrigerant through a condensor, further comprising the step of inserting the oil separation device in series with the closed cooling system between the compressor and condensor.

5. The method of claim 1 further comprising the step of overfilling the compressor cooling system with refrigerant during the oil cleansing cycle.

6. The method of claim 1 consisting of said cleaning cycle as a retrofit cleansing cycle with a chlorine free refrigerant.

7. The method of claim 1 consisting of the single cleansing cycle claimed in claim 1.

* * * * *